US005632460A

United States Patent [19]

Strickland

[11] Patent Number: 5,632,460

[45] Date of Patent: May 27, 1997

[54] LAMP HOLDER

[75] Inventor: Jerry D. Strickland, Jonesboro, Ark.

[73] Assignee: Partner Investments, Inc., West Memphis, Ark.

[21] Appl. No.: 418,277

[22] Filed: Apr. 7, 1995

[51] Int. Cl.[6] ..... A47G 23/02

[52] U.S. Cl. ..... 248/146; 248/151; 248/315

[58] Field of Search ..... 248/146, 151, 248/150, 315, 163.1

[56] References Cited

U.S. PATENT DOCUMENTS

| | | | |
|---|---|---|---|
| 35,363 | 5/1862 | Close | 248/146 |
| 577,829 | 2/1897 | Brown | 248/151 X |
| 1,056,669 | 3/1913 | Harris | 248/154 |
| 1,830,769 | 11/1931 | Rothermel | 248/154 |
| 2,203,632 | 6/1940 | Munsun et al. | 248/146 |
| 2,274,077 | 2/1942 | Marzolf | 248/151 |
| 2,772,845 | 12/1956 | Conant | 248/150 |
| 3,863,874 | 2/1975 | Pirovano | 248/150 |
| 4,064,993 | 12/1977 | Getner | 248/146 X |
| 4,889,300 | 12/1989 | Gibson et al. | 248/97 |

*Primary Examiner*—Philip C. Kannan

*Attorney, Agent, or Firm*—Walker, McKenzie & Walker, P.C.

[57] ABSTRACT

An improved lamp holder of the knock-down type. The lamp holder includes a circular band for contacting and encircling a lamp below the largest place on the lamp base, a plurality of legs, and a corresponding plurality of fasteners for respectively removably fastening the upper ends of each of the legs to the circular band for supporting the band in spaced relationship above a table top or the like. Each of the fasteners includes a bracket having an offset portion and a top portion establishing a downwardly opening socket which closely receives the upper end of a corresponding leg to precisely align a threaded hole in the upper end of the leg with an aperture in the circular band whereby a screw may be quickly and easily applied through the aperture and threaded into the threaded hole to secure the leg to the band for use by the customer.

4 Claims, 1 Drawing Sheet

LAMP HOLDER

BACKGROUND OF THE INVENTION

1. Field of the Invention

The present invention relates, in general, to a lamp holder, and in particular, to a lamp holder or stand of the type for holding a lamp in spaced relationship above a table top or the like.

2. Information Disclosure Statement

Heretofore, lamp holders or stands of the type for holding a lamp in spaced relationship above a table top or the like have included a circular band and a plurality of legs fixedly and permanently attached at the upper ends thereof to the circular band as by welding or the like. Such holders are typically sold separately from the lamps and in separate boxes, and such separately packaged holders in boxes take up considerable space. These previous relatively large boxes for the holders and for the lamps themselves resulted in increased shipping costs and the necessity of an increased amount of storage space in the warehouses and on the shelves in the retail stores.

Thus, there is a need to have a lamp holder which can be knocked-down, i.e. disassembled, so that the disassembled parts can be packaged in the same box with the lamp, and yet the knocked-down holder parts are of such a construction that they can be easily and quickly assembled into a lamp holder by the customer.

A preliminary patentability search in Class 362, subclasses, 382, 410, 412, and 450, and Class 248, subclasses 150, 151, 154, 310, and 311.2, produced the following patents, some of which may be relevant to the present invention: Harris, U.S. Pat. No. 1,056,669, issued Mar. 18, 1913; Rothermel, U.S. Pat. No. 1,830,769, issued Nov. 10, 1931; Conant, U.S. Pat. No. 2,772,845, issued Dec. 4, 1956; and Gibson et al, U.S. Pat. No. 4,899,300, issued Dec. 26, 1989. None of the above identified patents disclose or suggest the present invention.

SUMMARY OF THE INVENTION

The present invention is an improved lamp holder of the knock-down type, which includes a circular band means for contacting and encircling a lamp below a place on the base of the lamp which is larger than the inside diameter of the circular band means, a plurality of legs, and a corresponding plurality of fastening means for respectively removably fastening the upper ends of each of the legs to the circular band means for supporting the band means in spaced relationship above a table top or the like.

It is an object of the present invention to provide an improved lamp holder wherein instead of the legs being permanently attached to the circular band means of the holder, the legs are respectively removably attached to the circular band means by unique fastening means so that the legs can be removed and placed in the same box as the lamp with which it is to be used.

It is a further object to provide a lamp holder which when in the disassembled condition can be packaged in a relatively small space.

It is a further object to provide such fastening means that is easy for the customer to operate in assembling the legs with the circular band means.

A further object is to provide such fastening means which permits quick and accurate alignment of the threaded holes, respectively provided in the upper ends of the legs, with the corresponding apertures in the circular band means whereby screws may be quickly and easily applied to secure the legs to the circular band means.

It is a further object to provide such fastening means which provides efficient connections between the legs and the circular band means so that a sturdy lamp holder is provided when assembled.

DESCRIPTION OF THE PREFERRED EMBODIMENT

Figure 1:
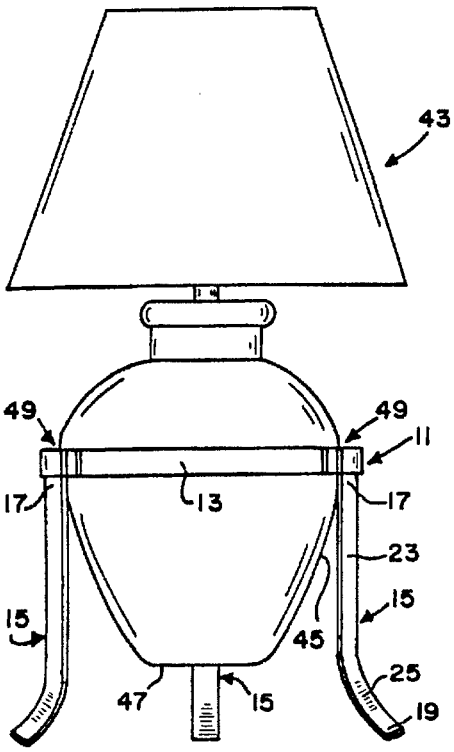
FIG. 1 is a view of the lamp holder of the present invention shown in combination with a lamp.
Figure 2:
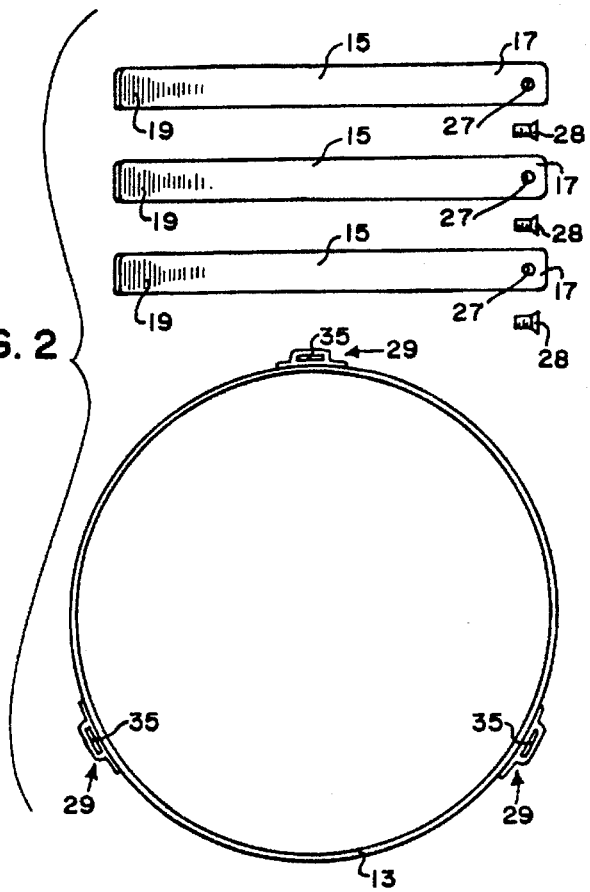
FIG. 2 is an enlarged exploded view of the lamp holder of the present invention, shown in a disassembled condition.
Figure 3:
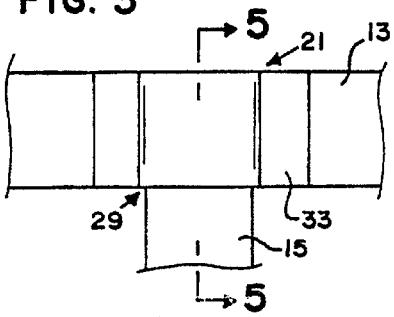
FIG. 3 is a further enlarged fragmentary view of a portion of the lamp holder in an assembled condition.

Referring to FIGS. 1–5, the holder 11 of the present invention includes, in general, a circular band means 13; a plurality of legs 15, preferably three in number, each having an upper end 17 and a lower end 19; and a corresponding plurality of fastening means 21, preferably three in number, for respectively removably fastening the upper ends 17 of each of legs 15 to circular band means 13. Legs 15 are substantially identical and the following description of one of legs 15 should suffice for all. Leg 15 has a straight portion 23 adjacent the upper end 17 thereof and an outwardly curved portion 25 adjacent the lower end 19 thereof. Leg 15 has a threaded hole 27 adjacent the upper end 17 thereof which extends through straight portion 23.

Figure 4:
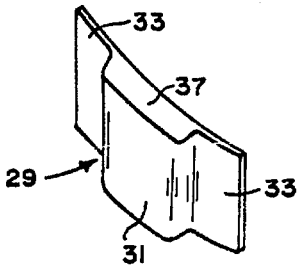
FIG. 4 is a perspective view of one of the brackets of the present invention.
Figure 5:
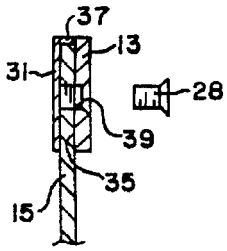
FIG. 5 is a sectional view taken as on the line 5—5 of FIG. 3.

Fastening means 21 are substantially identical and the following description of one of fastening means 21 will suffice for all. Each fastening means 21 comprises a screw 28, a bracket 29 including an offset center portion 31, a pair of wings 33 respectively fixedly attached to offset center portion 31 on opposite sides of the center portion 31 and extending outwardly therefrom in opposite directions, and means such as spot welding or the like, not shown, fixedly attaching wings 33 to circular band means 13 to establish with center portion 31 a downwardly opening socket 35 adapted to removably receive the upper end 17 of one of legs 15. Also, bracket 29 includes a top portion 37 fixedly attached to center portion 31 of bracket 29 and extending over socket 35 for limiting upward movement of leg 15 in socket 35 of bracket 29. Bracket 29 is preferably formed integrally from one piece of metal with the metal being bent and shaped to form the offset portion 31, and the top portion 37 preferably being formed as an upper part of offset portion 31 which is bent at a 90 degree angle with respect to the main vertical portion of offset portion 31, as best seen in FIGS. 4 & 5.

The three fastening means 21 are preferably respectively attached to band means 13 around the outside periphery thereof in equally spaced relationship, i.e., at 120 degree intervals. Circular band means 13 preferably has a plurality of apertures 39 extending therethrough respectively corresponding to the plurality of fastening means 21. Thus, there are preferably three apertures 39, spaced around the circumference of band means 13, with apertures 39 respectively being opposite the center portions 31 of brackets 29 and respectively in communication with sockets 35.

The relationship of fastening means 21 respectively with the corresponding legs 15 when the legs 15 are respectively inserted into sockets 35 during the use of holder 11, as will be more apparent in the description of the use thereof to follow later in the specification, is the same for all three of the legs 15 and the corresponding fastening means 21. Thus, the following description of the relationship of one of legs 15 with its corresponding fastening means 21 should suffice for all. Upper end 17 of leg 15 is dimensioned to fit closely within socket 35. When a leg 15 is placed into a socket 35 with the upper end 17 of the leg abutting the underside of top portion 37 of bracket 29, the threaded hole 27 in leg 15 is in close alignment with aperture 39, as best seen in FIG. 5 so that this provides ease of insertion of a screw 28 through aperture 39 and threadedly into threaded hole 27 to securely lock the leg 15 into place. This alignment is substantially a precise one, including alignment side-to-side as well as in a vertical direction.

It will be understood that since lamp holder 11 can be disassembled or knocked down, the disassembled parts, i.e., band means 13 with brackets 29 attached thereto, legs 15, and screws 28, can be packaged in the same box with the lamp 43, and yet the above mentioned knocked-down holder parts are of such construction that they can be easily and quickly assembled into the lamp holder 11 to be used by the customer.

Holder 11 is preferably used in a manner shown in FIG. 1. Thus, the lamp 43 with which used preferably has a base 45 which is larger at least at one place, as at 49, than the inside diameter of band means 13 so that lamp base 45 will pass only partially through band means 13, i.e., preferably only the lower portion extends through band means 13. For example, the particular lamp 43 shown has a graduated diameter, i.e., a diameter increasing from the bottom 47 of base 45 to a maximum diameter at the place shown as at 49.

Starting with holder 11 in a disassembled relationship, as the customer normally receives holder 11, to use holder 11, the upper ends 17 of legs 15 are respectively placed in sockets 35 of brackets 29 and screws 28 are respectively inserted through apertures 39 and threaded into threaded holes 27 to secure holder 11 in assembled relationship. Then, lamp base 45 is inserted into band means 13 through the top of the band means until lamp base 45 at the maximum diameter 49 thereof comes to rest against band means 13 so that the lamp 11 can be supported on a table or the like, not shown, with the bottom 47 of base 45 being spaced above the table top or the like.

Although the present invention has been described and illustrated with respect to a preferred embodiment and a preferred use therefor, it is not to be so limited since modifications and changes can be made therein which are within the full intended scope of the invention.

I claim:

1. A lamp holder for holding a lamp in spaced relationship above a table top or the like comprising:

(a) circular band means for contacting and encircling a lamp below a place on the base of the lamp which is larger than the inside diameter of the circular band means;

(b) a plurality of legs each having an upper end and a lower end, each of said legs including a threaded hole through the upper end thereof;

(c) a corresponding plurality of fastening means for respectively removably fastening the upper ends of each of said legs to said circular band means for supporting said band means in spaced relationship above a table top or the like, said circular band means including a plurality of apertures spaced around the circumference of said band means respectively corresponding to said plurality of said fastening means, each of said fastening means comprising:

i a bracket including an offset center portion, ii pair of wings respectively fixedly attached to said offset center portion on opposite sides of said center portion and extending outwardly therefrom in opposite directions, iii means fixedly attaching said wings to said circular band means to establish with said center portion a downwardly opening socket adapted to removably receive the upper end of one of said legs and iv a screw extending through an aperture in said band and threadedly engaged in a corresponding one of said threaded holes to hold its corresponding leg in place.

2. The lamp holder of claim 1 in which each of said brackets respectively include a top portion fixedly attached to the center portion of the bracket for limiting upward movement of the leg in the socket of the bracket to align the threaded hole in the leg with the corresponding aperture in the band for allowing placement of a screw through the corresponding aperture and into the threaded hole in the leg.

3. In combination, a lamp and a lamp holder having an inside diameter, said lamp comprising:

(a) a circular base having a bottom and having a place on said base that is larger than the inside diameter of said holder and spaced upwardly from the bottom of said base; and said lamp holder comprising:

(b) a circular band means having an inside diameter less than said place on said base of the lamp, said circular band means contacting and encircling said lamp adjacent and below said place on said base of the lamp;

(c) a plurality of legs each having an upper end and a lower end, each of said legs including a threaded hole through the upper end thereof; and (d) plurality of fastening means respectively removably fastening the upper ends of each of said legs to said circular band means for supporting said band means in spaced relationship above a table top or the like, said circular band means including a plurality of apertures spaced around the circumference of said band means respectively corresponding to said plurality of said fastening means, each of said fastening means including a screw extending through one of said apertures in said band means and threadedly engaged in a corresponding one of said threaded holes to hold its corresponding leg in place.

4. In combination, a lamp and a lamp holder having an inside diameter, said lamp comprising:

(a) a circular base having a bottom and having a place on said base that is larger than the inside diameter of said holder and spaced upwardly from the bottom of aid base; and said lamp holder comprising:

(b) circular band means having an inside diameter less than said place on said base of the lamp, said circular band means contacting and encircling said lamp adjacent and below aid place on said base of the lamp;

(c) a plurality of legs each having an upper end and a lower end; and (d) plurality of fastening means respectively removably fastening the upper ends of each of said legs to said circular band means for supporting said band means in spaced relationship above a table top or the like, each of aid fastening means comprising a bracket including an offset center portion, a pair of wings respectively fixedly attached to said offset center portion on opposite sides of said center portion and extending outwardly therefrom in opposite directions, and means fixedly attaching said wings to aid circular band means to establish with said center portion a downwardly opening socket removably receiving the upper end of one of said legs, each of said brackets respectively including a top portion fixedly attached to the center portion of the bracket for limiting upward movement of the leg in the socket of the bracket to align a threaded hole in the leg with a corresponding aperture in the band for allowing placement of a screw through the corresponding aperture and into the threaded hole in the leg.

* * * * *